United States Patent [19]

Larkin

[11] 4,009,533

[45] Mar. 1, 1977

[54] SAMPLE ENLARGING MATERIAL DISPLAY DEVICE

[76] Inventor: John M. Larkin, 6304 Colby Ave., Des Moines, Iowa 50311

[22] Filed: Jan. 19, 1976

[21] Appl. No.: 650,144

[52] U.S. Cl. ..... 40/28 B; 206/457

[51] Int. Cl.[2] ..... G09F 11/00; G09F 13/14; G09F 19/16; B65D 7/28

[58] Field of Search ..... 206/457, .81, 45.31, 206/462; 40/28 B

[56] References Cited

UNITED STATES PATENTS

| | | | |
|---|---|---|---|
| 168,343 | 10/1875 | Richardson | 40/28 B |
| 232,639 | 9/1880 | Griffith, Jr. | 40/28 B |
| 606,235 | 6/1898 | Peterson | 40/28 B |
| 661,725 | 11/1900 | Peterson | 40/28 B |
| 3,362,528 | 1/1968 | Deneke | 206/45.31 |

*Primary Examiner*—William T. Dixson, Jr.
*Attorney, Agent, or Firm*—Zarley, McKee, Thomte, Voorhees & Sease

[57] ABSTRACT

A device for displaying a sample of sheet material such as carpet or drapery comprises a floor wall having perimetric edges in a polygon shape and a plurality of walls extending upwardly from the perimetric edges thereof. Means are provided for connecting the upstanding walls at the adjoining vertical edges thereof so as to enclose the floor in a box-like configuration having an open upper end. The upstanding walls have mirror surfaces on their inwardly presented sides so that a viewer, looking through the opened upper end will see the illusion that the upper surface of the floor wall extends infinitely.

10 Claims, 10 Drawing Figures

SAMPLE ENLARGING MATERIAL DISPLAY DEVICE

SUMMARY OF THE INVENTION

This invention relates to a material display device, and particularly to a material display device for displaying samples of carpet, floor covering, draperies or other sheet materials.

A problem often encountered during the selling of carpet, wallpaper, floor covering and draperies is the difficulty the comsumer has in visualizing how a small sample of material would look when covering a significantly larger area. This is particularly difficult when the salesman calls at the customer's home and must therefore necessarily carry small samples of each material with him.

The need therefore has arisen for a display device which would enable the customer to visualize easily what the sample would look like when covering a larger area. Such a display device should also be capable of folding into a compact case to facilitate the transporting thereof. Light weight is also a desirable characteristic.

The present invention utilizes a box having an open end and having vertical walls with mirrors on their interior surfaces. The sample is placed on the floor of the box, and when the viewer looks into the box from the open upper end, the viewer sees an illusion created by the mirrors which gives the impression that the sample extends over an infinitely wide surface, thus illustrating what the sample would look like if it covered a large surface.

The display device of the present invention is foldable into a flat case which is light weight and which can easily be moved. A modified form of the invention also utilizes a display stand which may be placed in the showroom or department store where the particular fabric is being sold.

The mirrors on the interior surfaces may be constructed of various materials. Conventional glass mirrors may be used in the showroom model of this invention, but it is preferred that plastic materials of lighter weight be used for the portable, foldable modification. Therefore, a primary object of this invention is the provision for a material display device which is capable of displaying samples of material such as carpet, floor covering, wallpaper, drapery material or other materials.

A further object of this invention is a material display device which reflects the image of a small sample so as to give the illusion that the sample extends over a plane of infinite dimension.

A further object of this invention is the provision of a device which can be folded into a compact and lightweight carrying package.

A further object of this invention is the provision of a device which utilizes mirrors constructed of materials light in weight.

A further object of this invention is the provision for a device which is portable and can be folded easily into a compact operative configuration for transporting.

A further object of this invention is the provision for a device which is attractive in appearance, durable in use, and economical to manufacture.

DESCRIPTION OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings in which:

DETAILED DESCRIPTION

Figure 1:
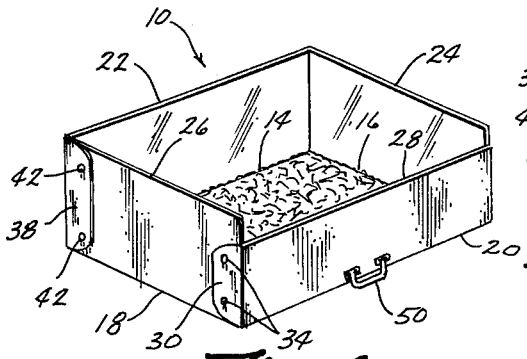
FIG. 1 is a pictorial view of the present invention.
Figure 2:
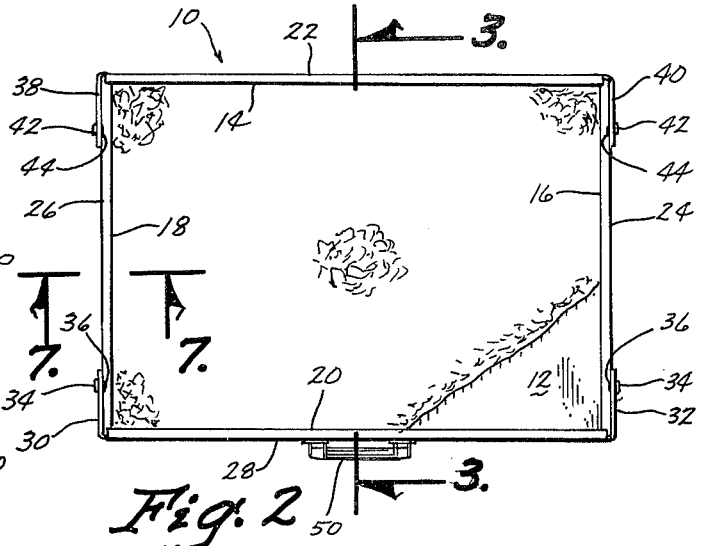
FIG. 2 is a top plan view of the present invention.
Figure 3:
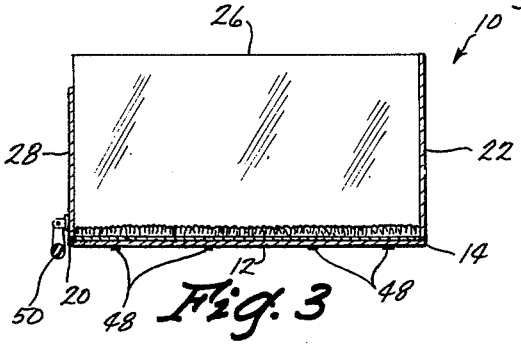
FIG. 3 is a sectional view taken along line 3—3 of FIG. 2.

Referring to the drawings, the numeral 10 generally designates the material display device of the present invention. Device 10 includes a bottom wall 12 having four perimeter edges 14, 16, 18 and 20. Hinged to perimeter edges 14, 16, 18 and 20 are a rear wall 22, two side walls 24, 26 and a front wall 28. Front wall 28 is rectangular in shape and includes a pair of flaps 30, 32 at its opposite ends. Flaps 30, 32 are provided with snaps 34 which are adapted to retentively engage snap elements 36 on side walls 24, 26.

Rear wall 22 is similarly provided with end flaps 38, 40 which are provided with snaps 42 adapted to retentively engage snap elements 44 in side walls 24, 26.

Figure 4:
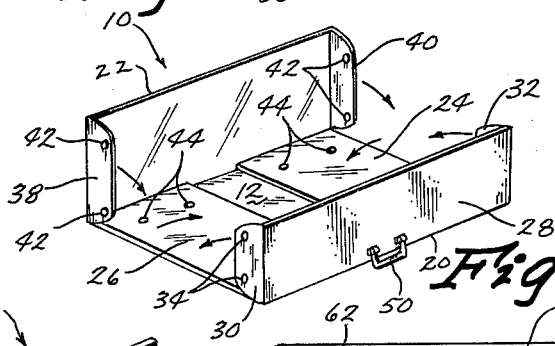
FIG. 4 is a perspective view illustrating the present invention in a partially folded configuration.
Figure 5:
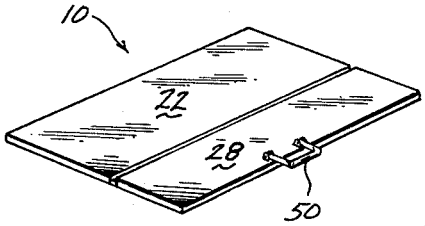
FIG. 5 is a pictorial view illustrating the device in a fully folded configuration.
Figure 6:
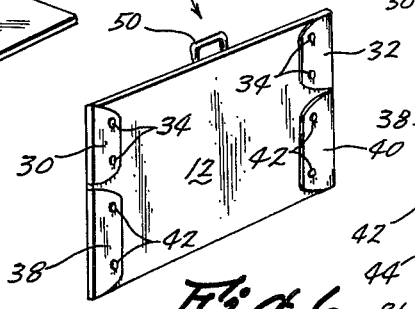
FIG. 6 is another pictorial view of the device shown in FIG. 5 in a fully folded condition.

Side walls 22, 24, 26 and 28 are pivotal about their hinge connections to the perimeter of bottom wall 12 and are adapted to pivot from an upstanding position (such as shown in FIG. 1) to a partially folded position (shown in FIG. 4) and finally to a fully folded position (shown in FIGS. 5 and 6). In a fully folded position, end flaps 30, 32 and 38, 40 are adapted to fold around the under surface of bottom wall 12 and to retentively engage a plurality of snap elements 48 to hold the device 10 in its fully folded position.

While snap elements are illustrated in the drawings, other types of securing means (such as Velcro, hooks, or any other securing means) could be used.

A handle 50 is operatively secured to front wall 28 adjacent its lower edge. Handle 50 is inoperative when device 10 is in the position shown in FIG. 1, but when device 10 is folded (FIG. 6) handle 50 is located to facilitate the carrying of device 10.

Each upstanding wall 22, 24, 26 and 28 is constructed of a rigid backing material 52 (FIG. 7), a reflective coating 54, and a transparent mirror coating 56. Backing material 52 may be comprised of wood, plastic, cardboard, or any other material which will lend rigidity to the upstanding walls. It may be provided with a decorative outer covering, such as leather, plastic, or other attractive material.

Figure 7:
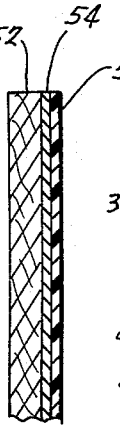
FIG. 7 is a sectional view taken along line 7—7 of FIG. 2.

FIG. 7 illustrates a preferred configuration for the portable unit as illustrated in FIGS. 1–6. Reflective layer 54 comprises a very thin foil operatively attached to backing material 52 and covered by a mirror coating 56 comprised of a transparent polyester film. An example of such a polyester film is the transparent film manufactured by E. I. du Pont de Nemours & Co. under the trade name "Mylar."

Figure 8:
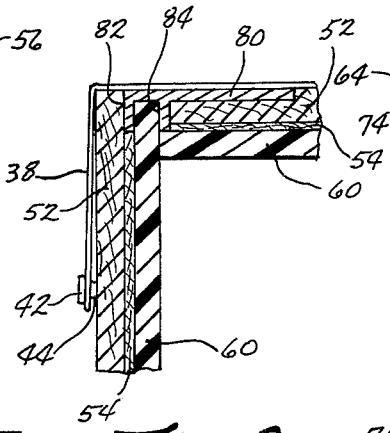
FIG. 8 is a view similar to FIG. 7, illustrating one corner of a device having an alternative form of mirror.

FIG. 8 illustrates another form of transparent coating which may be used. A backing material 52 may be utilized, as well as a reflective layer 54. Layer 54 may be covered with either glass or a transparent acrylic sheet member, designated by the numeral 60 in FIG. 8.

By way of comparison, it has been found that a device manufactured to fit conventional carpet sample sizes has a weight of approximately 6 pounds when constructed with Mylar; approximately 13 pounds when manufactured with the acrylic transparent coating; and approximately 20 pounds when constructed with a glass mirror.

FIG. 8 also illustrates a preferred form for corner construction of the present invention. An elongated channel 80 having an F-shaped cross-section is mounted at each end of rear wall 22 and front wall 28. Channel 80 may be made of suitable rigid material such as aluminum or plastic. Channel 80 includes a pair of flanges 82, 84 sized to slidably embrace the end edges of the sheet member 60 of end walls 24, 26 so as to form a rigid corner joint.

Figure 9:
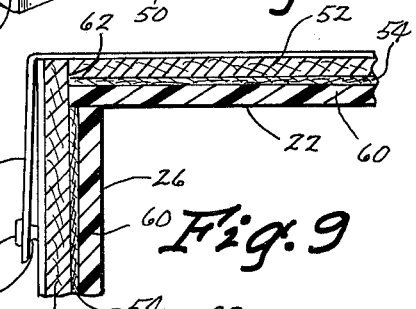
FIG. 9 is an enlarged view of a modified corner construction.

FIG. 9 illustrates a corner joint between side wall 26 and rear wall 22. The opposite ends of side walls 24, 26 are each provided with a rabbit groove 62 which is adapted to matingly receive the opposite ends of rear wall 22 and front wall 28. When flap 38 is pulled tightly around the corner formed between rear wall 22 and side wall 26 and is snapped in place by means of snap 42, a rigid, secure corner joint is provided. Similar rigid corner joints are provided at the remaining four corners when the flaps are snapped in position.

Figure 10:
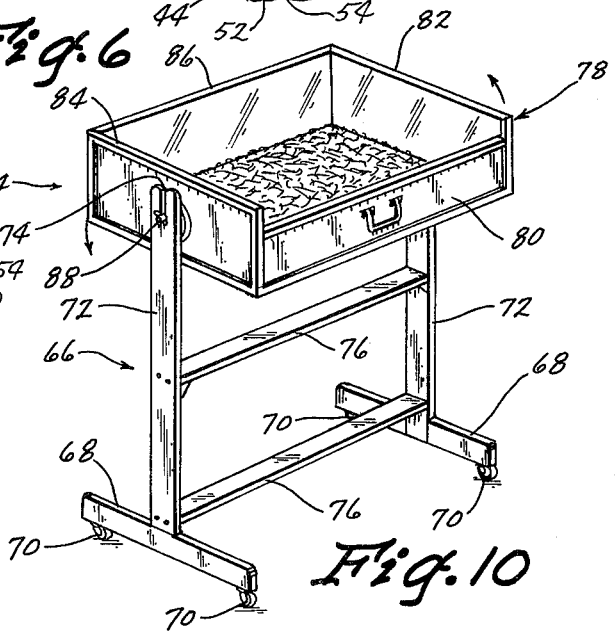
FIG. 10 is a pictorial view of a modified form of the present invention.

Referring to FIG. 10, a modified form of the invention for use in showroom or department store display, is designated by the numeral 64. Device 64 includes a stand 66 having opposite end frames comprised of a lower horizontal bar 68 having casters 70 thereon and having an upstanding vertical member 72 extending upwardly therefrom. The upper end of upstanding member 72 is provided with a vertical groove 74. Vertical members 72 are interconnected by means of cross braces 76. A display box 78 is provided with a front wall 80, side walls 82, 84 and a rear wall 86, each having interiorly presenting mirror surfaces. Extending outwardly from each sidewall 82, 84 is a bolt which extends through one of the grooves 74 and is secured in place by means of a wing nut 88. Thus, box 78 may be pivoted about the pivotal connection within vertical grooves 74 from a horizontal position, such as shown in FIG. 10, to a vertical position wherein box 78 lies in a plane approximately parallel to upstanding members 72. Box 10 can be adjusted to any desired position merely by loosening nuts 88 and tightening them when the box has reached the desired position. The carpet or other sample material can be placed in the bottom of the box and viewed by the customer. When the viewer observes the carpet in this position, an illusion is created, giving the observer the impression that the carpet extends in a continuous plane of infinite dimension.

Thus, it can be seen that the device accomplishes at least all of its stated objectives. Both the device shown in FIG. 1 and the device shown in FIG. 10 provided means for displaying material such as carpet or fabric. The device reflects the image of a small sample so as to give the illusion that the sample extends infinitely in a continuous plane. The device of FIG. 1 can be folded into a compact and light-weight carrying package and utilizes mirrors constructed of light-weight material. The device is portable and can be easily folded from its operative to inoperative position. It is attractive in appearance, durable in use, and economical to manufacture.

I claim:

1. A device for displaying a sheet of material comprising;

a floor wall having perimetric edges in a rectangular shape;

an upstanding wall extending upwardly from each of said perimetric edges and being hinged thereto for pivotal movement about an axis approximately coincident with said perimetric edge from an upstanding position to a folded position in facing relation to said floor wall;

said upstanding walls having adjoining vertical edges when in said upstanding position so as to close said floor wall in a rectangular configuration having an open upper end;

securing means connected to at least some of said vertical edges of said upstanding walls, said securing means being adapted to retentively engage the adjoining upstanding wall when said upstanding walls are in their upstanding position, and being adapted to retentively engage said floor wall when said upstanding walls are in their folded position;

said upstanding walls having mirror surfaces on their inwardly presented sides so that a viewer looking through said open upper end will see the illusion that said upper surface of said floor wall extends infinitely, said mirrored surfaces facing inwardly toward said bottom wall when in said folded position.

2. A device according to claim 1 wherein said securing means comprises a flap connected to at least one of said upstanding walls adjacent one of the vertical edges thereof, said flap having fastening means thereon adapted to retentively detachably engage corresponding fastening means on the outside surface of said adjacent upstanding wall and on the outside surface of said bottom wall.

3. A device according to claim 2 wherein when in said folded position all of said upstanding walls are in facing relation to said bottom wall and said securing means are detachably secured to said bottom wall to hold said upstanding walls in their folded position.

4. A device according to claim 1 wherein three of said four upstanding walls have the same height, and the fourth wall has a height slightly less than that of the other three upstanding walls.

5. A device according to claim 1 wherein each of the said upstanding walls comprises an outer backing sheet member, a central reflecting surface, and an inner transparent surface.

6. A device according to claim 5 wherein said transparent surface is an acrylic sheet member.

7. A device according to claim 5 wherein said reflecting surface is a foil and said transparent surface is a coating of polyester film on said foil.

8. A device according to claim 5 wherein one of said adjoining vertical edges at each corner of said rectangle is provided with a channel having a pair of spaced apart flanges slidably embracing said vertical edges of the adjoining reflecting surface and transparent surface therebetween.

9. A device according to claim 5 wherein one of said adjacent vertical edges is provided with a rabbit groove which matingly receives the other adjacent vertical edge to form a corner joint, said securing means extending around said corner joint to hold said adjacent vertical edges together.

10. A device for displaying a sheet of material comprising: a floor wall having parametric edges in a rectangular shape;

an upstanding wall extending upwardly from each of said parametric edges and being hinged thereto for pivotal movement about an axis approximately coincident with said parametric edge from an upstanding position to a folding position in facing relation to said floor wall;

said upstanding walls having adjoining vertical edges when in said upstanding position so as to close said floor wall in a rectangular configuration having an open upper end;

holding means for holding the adjacent vertical edges of said walls together in said upstanding position, said holding means being releasable to permit said upstanding walls to fold to said folded position;

said upstanding walls having mirror surfaces on their inwardly presented sides so that a viewer looking through said open upper end will see the illusion that said upper surface of said floor wall extends infinitely, said mirrored surfaces facing inwardly toward said bottom wall when in said folded position.

* * * * *